United States Patent [19]

Takahashi et al.

[11] Patent Number: 4,901,930

[45] Date of Patent: Feb. 20, 1990

[54] WINDING APPARATUS FOR DEFLECTION YOKE

[75] Inventors: Kuniaki Takahashi; Kazuyoshi Kajiwara; Masatoshi Itoh, all of Kisakata, Japan

[73] Assignee: TDK Corporation, Tokyo, Japan

[21] Appl. No.: 222,253

[22] Filed: Jul. 21, 1988

[51] Int. Cl.[4] ..... H01F 41/08

[52] U.S. Cl. ..... 242/4 BE; 242/7.14

[58] Field of Search ..... 242/7.06, 7.07, 4 R, 242/4 B, 4 BE, 4 C, 5, 6, 7.04, 7.09, 7.13, 7.14, 7.15; 336/198, 207, 208; 29/605; 140/92.1; 335/210

[56] References Cited

U.S. PATENT DOCUMENTS

| | | | |
|---|---|---|---|
| 3,163,794 | 12/1964 | Bloomsburgh et al. | 335/210 |
| 3,601,731 | 8/1971 | Christiana | 335/210 |
| 3,895,329 | 7/1975 | Logan et al. | 335/210 |
| 4,081,773 | 4/1978 | Nitzsche | 336/208 |
| 4,093,132 | 6/1978 | Christiana et al. | 242/7.03 |
| 4,712,080 | 12/1987 | Katou | 335/210 |

FOREIGN PATENT DOCUMENTS

| | | | |
|---|---|---|---|
| 1197537 | 7/1965 | Fed. Rep. of Germany | 242/4 BE |

*Primary Examiner*—Joseph J. Hail, III

*Attorney, Agent, or Firm*—Oblon, Spivak, McClelland, Maier & Neustadt

[57] ABSTRACT

A winding apparatus for a deflection yoke capable of attaining winding operation at a high speed. The apparatus includes a rotor arranged in a manner to be inserted through a cylindrical spool of the deflection yoke which has an inner surface formed with longitudinal slots thereon. Reciprocating rotation of the rotor causes a wire to be introduced into any desired one of the longitudinal slots of the cylindrical spool and wound in the slot.

14 Claims, 14 Drawing Sheets

WINDING APPARATUS FOR DEFLECTION YOKE

BACKGROUND OF THE INVENTION

1. Field of the Invention

. This invention relates to a winding apparatus for a deflection yoke, and more particularly to an apparatus for carrying out winding of a wire on a spool or frame of a deflection yoke for deflecting electron beams emitted from a cathode ray tube.

2. Description of the Prior Art

A conventional winding apparatus of such type is typically constructed in such a manner as disclosed in Japanese Patent Publication No. 23050/1974, the disclosure of which is incorporated herein by reference. More particularly, the conventional winding apparatus includes a wire feed head arranged so as to be vertically movable and is adapted to support a frame or spool of a deflection yoke in a manner to be slidable and rotatable in a horizontal plane, so that a combination of vertical movement of the coil feed head, sliding movement of the deflection yoke, and rotation of the spool causes winding of a wire on the spool of the deflection yoke to be automatically accomplished.

Unfortunately, the conventional winding apparatus requires linear reciprocating motion of both the wire feed head and deflection yoke, resulting in failing to carry out winding operation at a high speed. Also, in order that the conventional winding apparatus satisfactorily accomplishes automatic winding, the spool of the deflection yoke must be limited to a specific configuration. Further, the conventional winding apparatus has another disadvantage that a wire is biasedly or non-uniformly wound in longitudinal slots of the spool of the deflection yoke.

In addition, in a deflection yoke, it is generally required to form coils in pairs in a circumferential direction of the yoke. However, the conventional winding apparatus, as shown in FIGS. 1 and 2, successively carries out winding of a wire on pairs of slots a-b, c-d, e-f, g-h, and i-j of longitudinal slots 10 many times, to thereby form a left coil including coil sections L1 (between slots a-b), L2 (c-d), L3 (e-f), L4 (g-h), and L5 (i-j). Then, it likewise carries out winding of a wire between pairs of slots a'-b', c'-d', e'-f', g'-h', i'-j' of longitudinal slots 11 in order, resulting in a right coil consisting of coil sections L1'(between slots a'-b'), L2'(c'-d'), L3'(e'-f'), L4'(g'-h'), and L5'(i'-j'). Thus, the conventional winding apparatus fails to continuously or successively form both the left and right coils. Also, it fails to successfully draw out an intermediate tap.

Accordingly, it would be highly desirable to develop a winding apparatus for a deflection yoke which is capable of carrying out uniform winding of a wire on a deflection yoke at a high speed and with high reliability, accurately feeding a wire to the deflection yoke, and successively forming a pair of left and right coils.

SUMMARY OF THE INVENTION

Generally speaking, in accordance with the present invention, a winding apparatus for a deflection yoke is provided. The apparatus includes a rotor arranged in a manner to be inserted through a cylindrical spool of the deflection yoke which is formed on an inner surface thereof with a plurality of longitudinal slots. The rotor is rotated to cause a wire to be introduced into the longitudinal slots of the cylindrical spool.

OBJECTS OF THE INVENTION

Accordingly, it is an object of the present invention to provide a winding apparatus for a deflection yoke which is capable of attaining winding operation at a high speed.

It is another object of the present invention to provide a winding apparatus for a deflection yoke which is capable of accomplishing winding of a coil on a deflection yoke with high reliability.

It is a further object of the present invention to provide a winding apparatus for a deflection yoke which is capable of being highly simplified in structure.

It is still another object of the present invention to provide a winding apparatus for a deflection yoke which is capable of being widely applicable to any deflection yoke irrespective of a spool of the deflection yoke.

It is yet another object of the present invention to provide a winding apparatus for a deflection yoke which is capable of accomplishing uniform winding of a wire on a deflection yoke.

It is still a further object of the present invention to provide a winding apparatus for a deflection yoke which is capable of positively and accurately supplying a wire to a deflection yoke.

It is yet a further object of the present invention to provide a winding apparatus for a deflection yoke which is capable of successively forming a pair of left and right coils.

It is an even further object of the present invention to provide a winding apparatus for a deflection yoke which is capable of drawing out an intermediate tap as desired.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings in which like reference numerals designate like or corresponding parts throughout; wherein:

FIG. 25 is a fragmentary front elevation view in section showing arrangement of a support table and the like;

DETAILED DESCRIPTION OF THE PREFERRED EMBODIMENT

Now, a winding apparatus for a deflection yoke according to the present invention will be described hereinafter with reference to the accompanying drawings.

Figure 3:
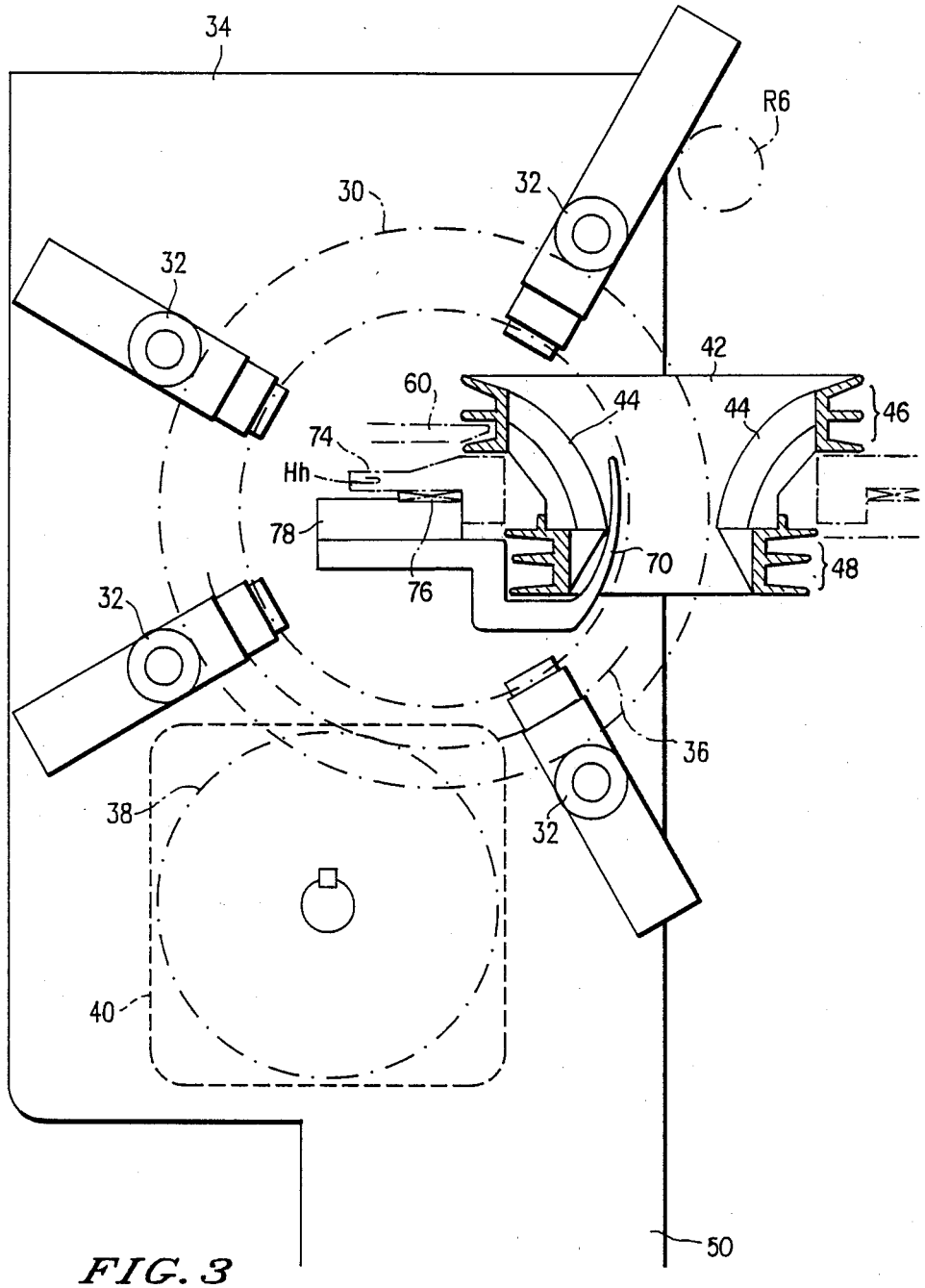
FIG. 3 is a schematic front elevation view showing an embodiment of a winding apparatus for a deflection yoke according to the present invention.
Figure 4:
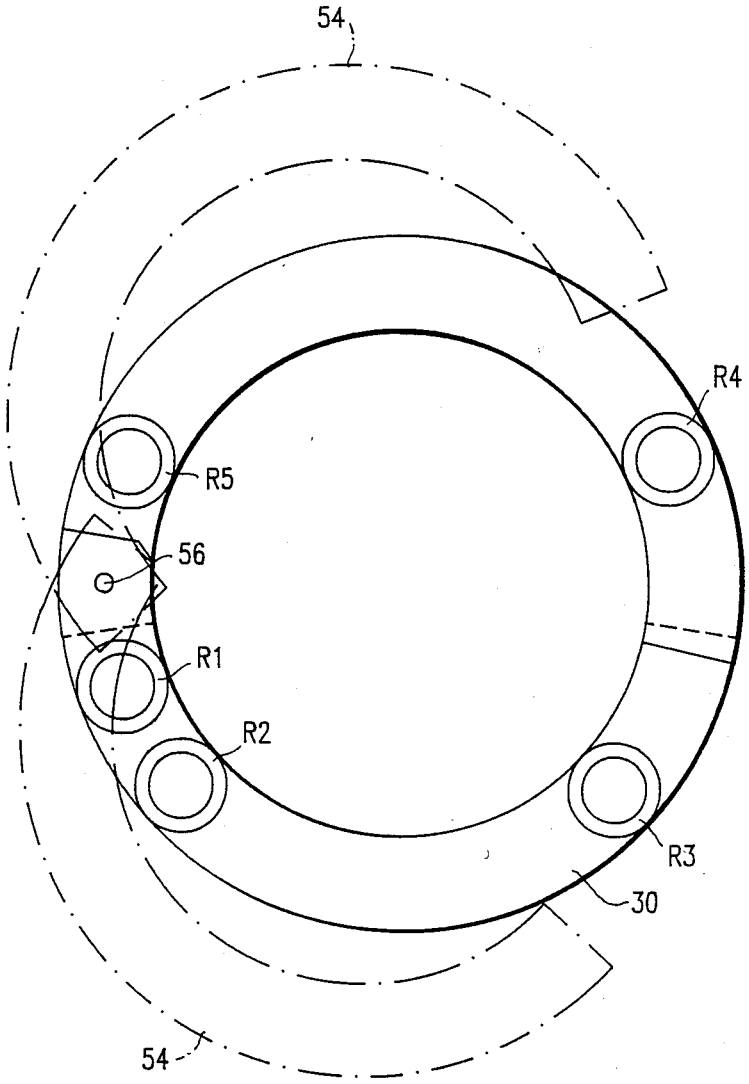
FIG. 4 is a front elevation view showing a rotor.
Figure 5:
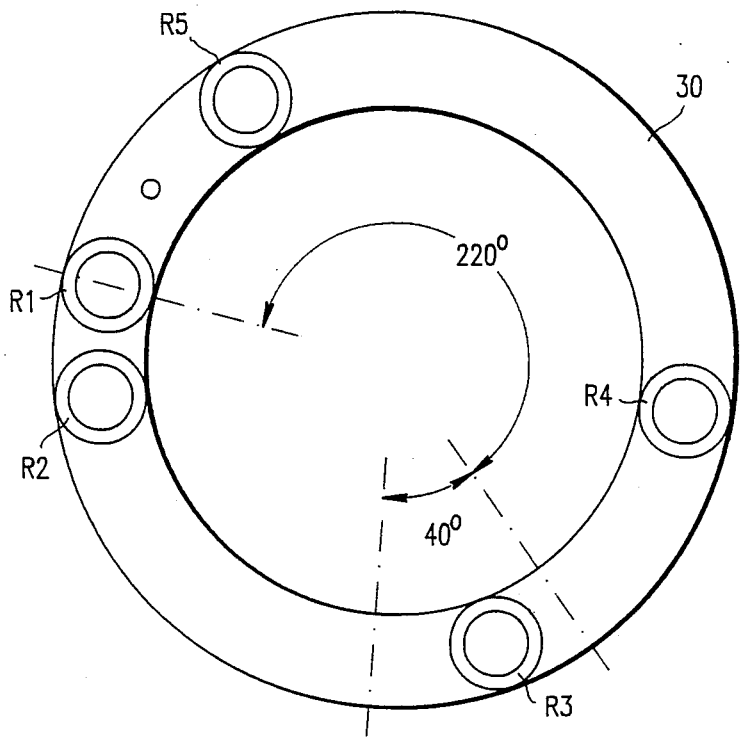
FIG. 5 is a front elevation view showing a rotor arranged at its original position.
Figure 8:
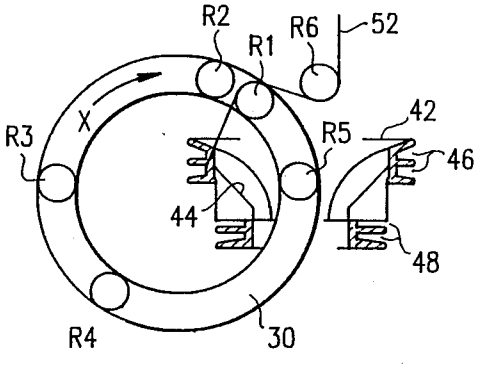
FIGS. 6 to 12 each are a schematic front elevation view showing operation of a rotor for winding a wire on a spool of a deflection yoke.
Figure 7:
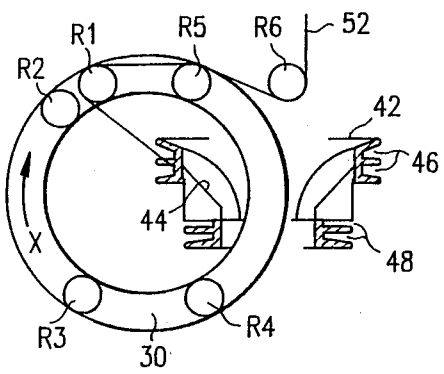

FIGS. 3 to 5 show an embodiment of a winding apparatus for a deflection yoke according to the present invention. A winding apparatus of the illustrated embodiment includes a rotor 30 which is formed into an annular shape and rotatably supported at an outer periphery thereof on a plurality of rollers 32 provided on a frame 34 of the apparatus. In the illustrated embodiment, it is supported by four such rollers 32. The rotor 30 is provided with a gear 36, which is engaged with a gear 38 of a motor 40 to transmit revolving force of the motor 40 to the rotor 30.

A frame or spool of a deflection yoke on which the rotor is to carry out winding operation is designated by reference numeral 42 in FIG. 3 and, as shown in FIGS. 3 and 5, formed into a substatially cylindrical shape, which is known in the art. The rotor 30 is so arranged that it may be partially inserted through the spool or frame 42 as shown in FIG. 3. As is known to those skilled in the art, the spool 42 is formed on an inner surface thereof into a substantially trumpet-like shape and has a plurality of axially extending longitudinal slots or grooves 44, which are arranged at angular intervals of $\alpha$. FIG. 3 substantially shows an inner configuration of the spool 42. Also, the spool 42 is formed at upper and lower ends of each section of the inner surface interposed between adjacent longitudinal slots 44 with sideways or circumferential annular channels 46 and 48 for connecting the adjacent longitudinal slots or grooves 44 to one another therethrough, respectively. Thus, the upper and lower channels 46 and 48 each are divided into a plurality of sections in an intermittent manner corresponding to the longitudinal slots. The so-constructed spool 42 may be supported on a support mechanism or table 50 so that it may be intermittently rotated at an angle of $\alpha$ which is an angle of arrangement between the slots 44. The support mechanism or table 50 may be detachably constructed for replacement of the spool 42, as detailed described below.

The rotor 30, as shown in FIGS. 4 and 5, includes a plurality of rollers R1 to R5 which are arranged thereon in order in a counterclockwise direction for selectively guiding a wire 52 (FIG. 6) while contacting with the wire. In the illustrated embodiment, five such rollers are arranged on the rotor 30. The rotor 30 is formed of two halves 54 which are pivotally connected together through a joint pin 56, resulting in the rotor 30's being pivotally openable as indicated in phantom lines in FIG. 4 for insertion of the spool 42 into the rotor 30 and replacement of the spool 42. In the illustrated embodiment, the rollers R1 to R5 are arranged in such a manner as shown in FIG. 5. More particularly, the roller R3 is provided at a position spaced by an angle of 220° to 260° in a right or clockwise direction from the roller R1, the roller R2 is arranged at a position in a counterclockwise direction based on the roller R1 and in proximity thereto, and rollers R5 and R4 are arranged in order at positions spaced in a clockwise direction from the roller R1 and interposed between the rollers R1 and R3. Reference character R6 (FIG. 6) indicates a guide roller provided on the frame 34, which, in the illustrated embodiment, is positioned between the rollers R5 and R4 based on a center of the rotor 30 when the rotor 30 is at its original position.

The manner of operation of the winding apparatus of the illustrated embodiment constructed as described above will be described hereinafter with reference to FIGS. 6 to 20, in which the inner configuration of the spool 42 is schematically shown.

Figure 6:
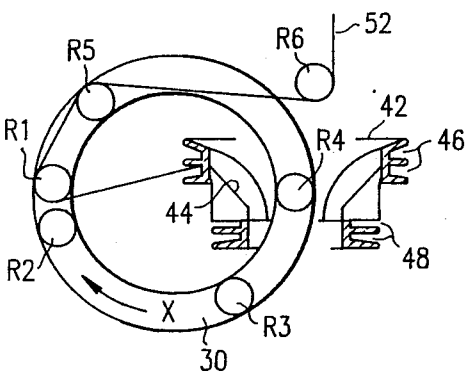
Figure 11:
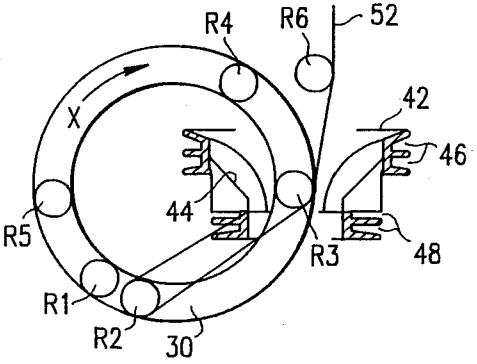
Figure 10:
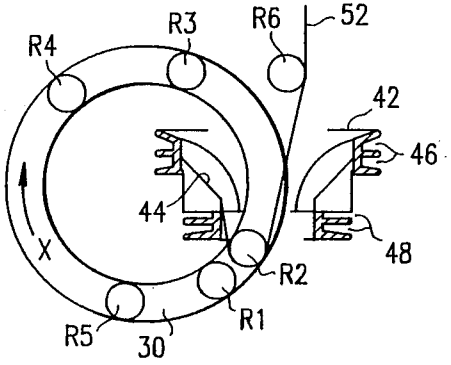
Figure 9:
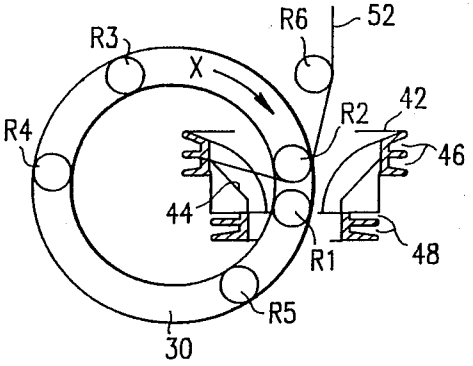

First, as shown in FIG. 6, the rotor 30 is arranged so as to be fitted at a part thereof around the cylindrical spool 42 of the deflection yoke in a predetermined manner, resulting in being at an original position shown in FIG. 6. Then the wire 52 is held at any desired portion thereof on an upper end of one of the longitudinal slots 44. Then, the wire 52 is stretchedly wound on the rollers R1, R5, and R6 in turn and then guided to a tension device (not shown) to apply predetermined tension thereto.

Figure 12:
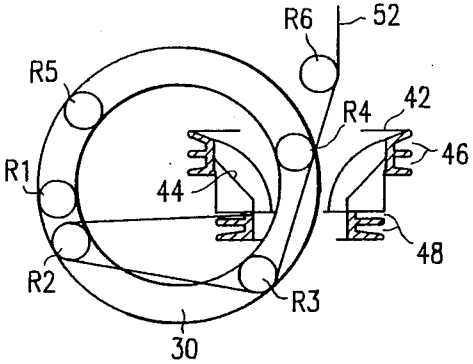
Figure 17:
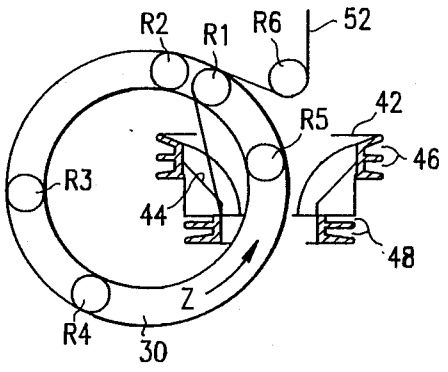
Figure 16:
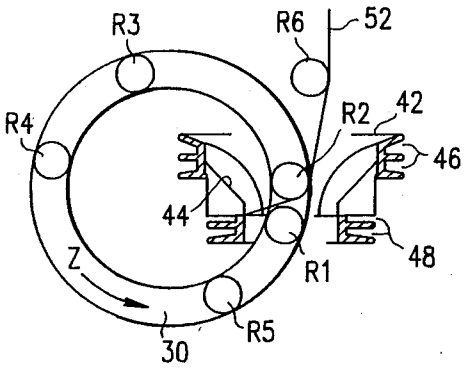
Figure 15:
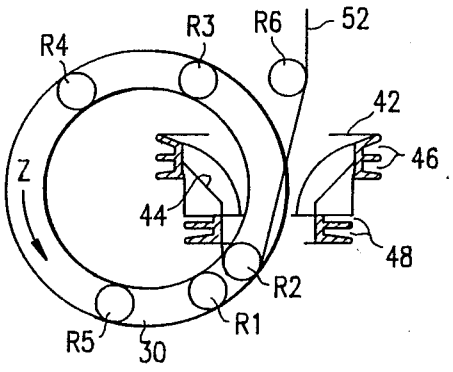

Then, the rotor 30 is rotated in a clockwise direction from the original position of FIG. 6 through positions shown in FIGS. 7 to 11 to a position shown in FIG. 12, as indicated at an arrow X in each of FIGS. 6 to 11. Thus, operation shown in FIGS. 6 to 12 causes the wire 52 to be introduced in the specified one of the longitudinal slots 44 and guided from its upper end to its lower end.

Figure 13:
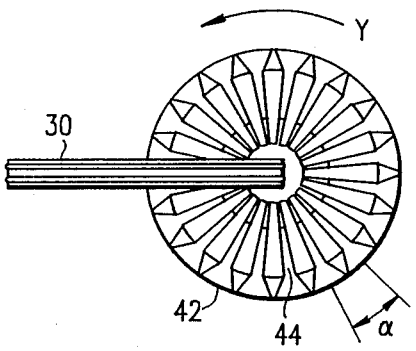
FIG. 13 is a schematic plan view showing operation of a rotor.

Subsequently, as shown in FIG. 13, the frame or spool 42 of the deflection yoke is rotated in a counterclockwise direction Y in a horizontal plane by an angle equal to the angle $\alpha$ between the longitudinal slots 44. This results in the wire 52 being introduced into the lower lateral or circumferential annular channel 48 through which lower ends of the longitudinal slots 44 are communicated with one another.

Figure 14:
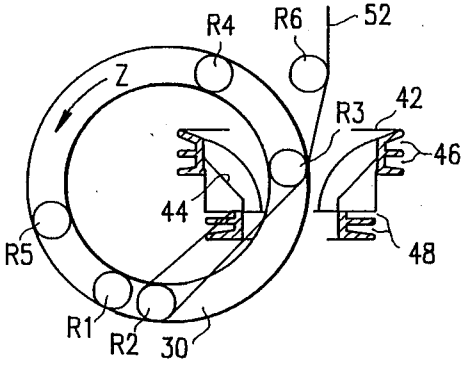
FIGS. 14 to 19 each are a schematic front elevation view showing further operation of a rotor.
Figure 19:
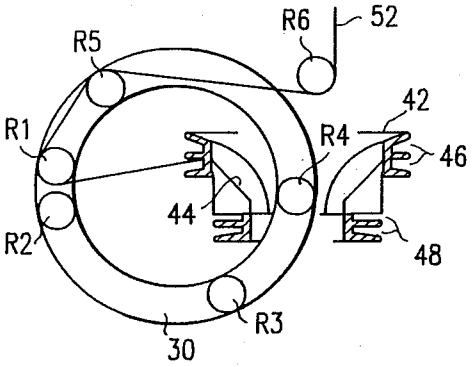
Figure 18:
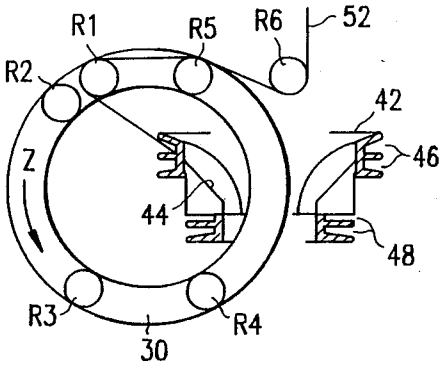

Then, the rotor 30 is reversely rotated in a counterclockwise direction as indicated at an arrow Z in FIG. 14 and returned through positions shown in FIGS. 15 to 18 to the original position as shown in FIG. 19. This causes the wire 52 engaged with the lower channel 48 to be introduced in the next longitudinal slot 44 and guided from its lower end to its upper end.

Figure 20:
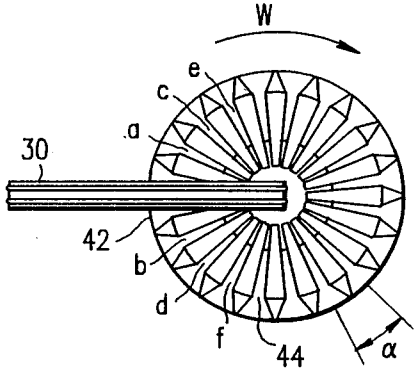
FIG. 20 is a plan view showing operation of a rotor.

Thereafter, the spool 42 is rotated in a clockwise direction as indicated at an arrow W in FIG. 20 in a horizontal plane by an angle of $\alpha$, so that the wire 52 may be introduced in the upper sideways or circumferential channel 46.

Again, the above-described procedures shown in FIGS. 6 to 20 are repeated plural times to carry out winding operation, resulting in the wire 52 being wound between the adjacent longitudinal slots 44 plural times.

Similarly, the winding operation is successively carried out with respect to each pair of the remaining longitudinal slots 44 (slots a-b, c-d, e-f, --- in FIGS. 20) positioned on both sides of the adjacent longitudinal slots 44 on which the winding operation has been carried out as described above.

As can be seen from the foregoing, the winding apparatus of the illustrated embodiment is constructed in the manner that the rotor is arranged in a manner to be inserted through the cylindrical spool of the deflection yoke, so that rotation of the rotor may cause the wire to be introduced in each of the longitudinal slots formed on the inner surface of the cylindrical spool. Such construction permits the winding operation to be accomplished by only rotational motion. This results in the winding operation being practiced at a high speed. An experiment by the inventors revealed that the winding apparatus of the present invention accomplishes the winding operation at a speed ten times as high as that in the conventional winding apparatus or more. Also, such construction highly simplifies the whole structure of the winding apparatus and allows the apparatus to be applied to a variety of spools.

The illustrated embodiment may be constructed so as to permit winding of the coil on the spool to be uniformly carried out. For this purpose, the winding apparatus of the illustrated embodiment may be provided with a winding alignment guide indicated by reference numeral 60 in FIG. 3.

Figure 21:
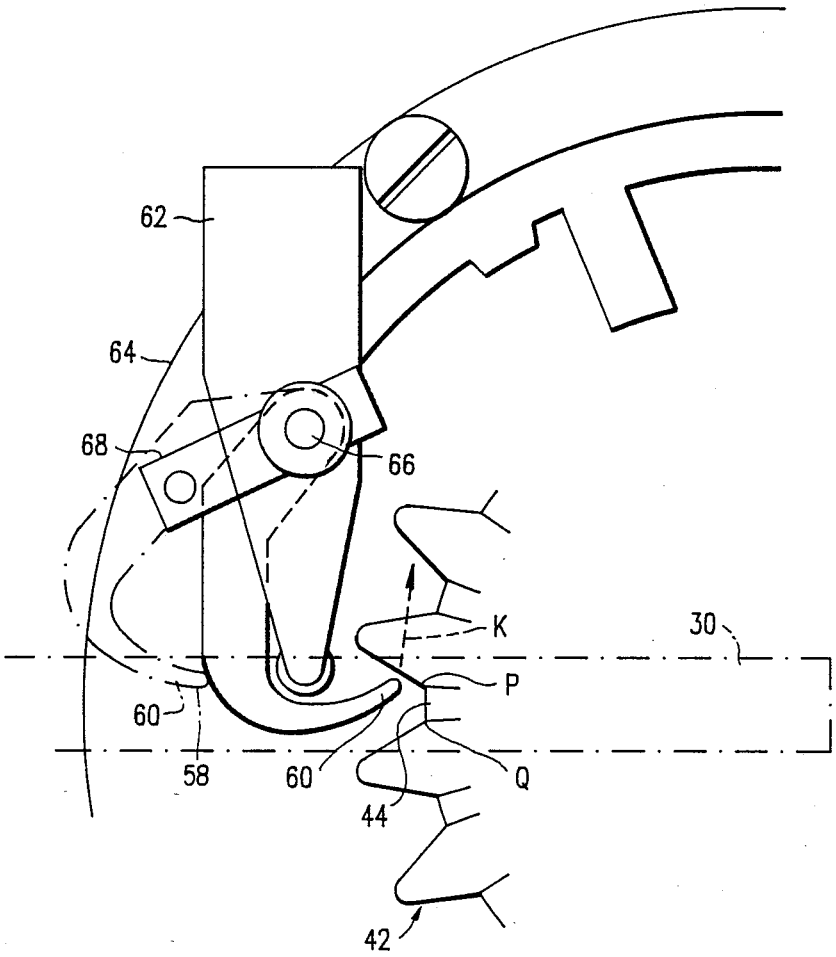
FIG. 21 is a fragmentary plan view showing arrangement of a winding alignment guide.

More particularly, the winding alignment guide 60, as shown in FIG. 21, is arranged in such a manner that its tip end 58 is closely opposite to an upper end of the longitudinal slot 44, resulting in preventing biased winding of the wire in slot 44. As shown in FIG. 21, a bracket 62 is fixed on a support 64 mounted on a side of the frame 34 of the apparatus. The winding alignment guide 60 is pivotally supported on the bracket 62 at a rear end thereof through a shaft 66. This causes the winding alignment guide 60 to be reciprocated between a position at which it is closely opposite to the longitudinal slot 44 and which is indicated in solid lines in FIG. 21 and a retracted position indicated in phantom lines. Also, force for driving the winding alignment guide 60 is applied from a driving source (not shown) such as a cylinder through an arm 68 fixed on the shaft 66 to the winding alignment guide 60. The winding alignment guide 60 is moved to the retracted position when the spool 42 of the deflection yoke is rotated.

Figure 22:
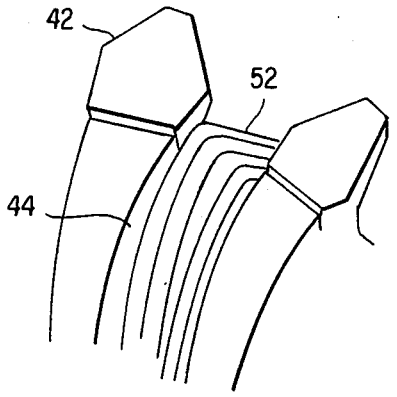
FIG. 22 is a fragmentary perspective view showing winding of a wire on a spool of a deflection yoke which is accomplished when the winding alignment guide of FIG. 21 is arranged.
Figure 23:
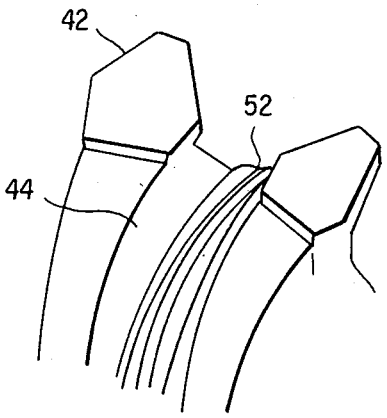
FIG. 23 is a fragmentary perspective view showing winding of a wire on a spool of a deflection yoke carried out when the winding alignment guide of FIG. 21 is not arranged.

During the winding operation described above with reference to FIGS. 6 to 20, the winding alignment guide 60 causes the wire 52 to be initially biasedly wound on a side P of the slot 44 due to tension applied in a direction indicated by an arrow K in FIG. 21. However, when the wire is wound in this state predetermined times to reduce an interval between the tip end 58 of the winding alignment guide 60 and the bottom of the slot 44, winding of the wire 52 on a side Q of the slot 44 is started by the winding alignment guide 60. This results in the winding being uniformly carried out as shown in FIG. 22. On the contrary, when such winding alignment guide 60 is not provided, the wire 52 is biased wound in the slot 44 as shown in FIG. 23.

Further, the illustrated embodiment may be so constructed that the wire may be positively guided to the longitudinal slots 44 of the spool to ensure the winding with high accuracy.

Figure 24:
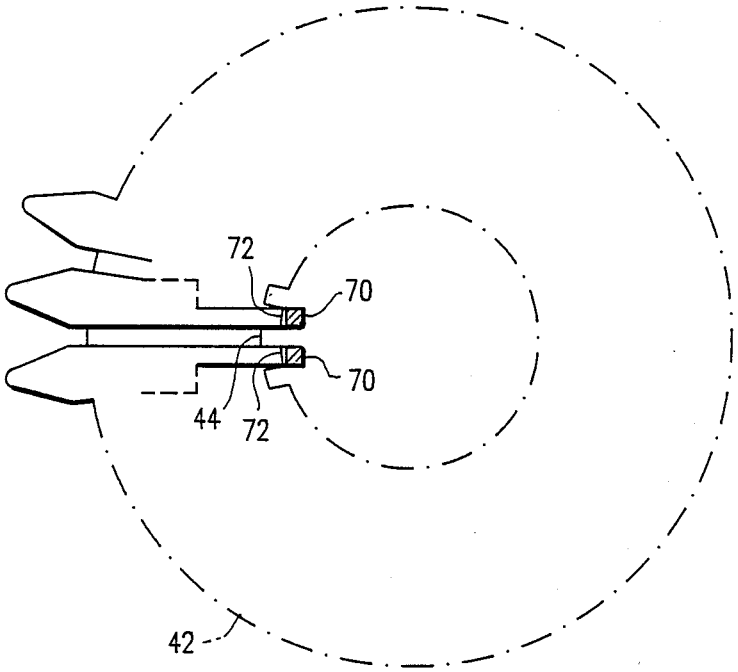
FIG. 24 is a fragmentary plan view partly in section showing a stationary winding guide.

For this purpose, the winding apparatus of the illustrated embodiment, as briefly shown in FIG. 3 and detailedly shown in FIG. 24, is provided with a stationary winding guide 70 for accomplishing winding of the wire 52 in the longitudinal slots 44 with high accuracy and reliability. The stationary winding guide 70 is arranged in a manner to be closely opposite to projections 72 of the inner surface of the spool 42 between which each longitudinal slot 44 is defined. In the illustrated embodiment, the stationary winding guide 70 is adapted to be opposite to any adjacent two of the projections 72 as shown in FIG. 24. More particularly, the stationary winding guide 70 is formed into a curved shape corresponding to the trumpet-like inner surface of the spools 42 and arranged in close proximity to the projections 72. The stationary winding guide 70 is fixed at a lower end thereof on the frame 34 of the winding apparatus.

During the winding operation described above with reference to FIGS. 6 to 20, the stationary winding guide 70 constructed as described above effectively prevents the wire 52 from erroneously entering another one of the longitudinal slots 44, to thereby highly improve reliability of the winding operation because it is arranged in close proximity to the adjacent projections 72 of the inner surface of the spool 42.

Furthermore, the illustrated embodiment may be so constructed that a pair of left and right coils may be successively or continuously formed and, as required, an intermediate tap may be drawn out. For this purpose, a support mechanism or table 74 is provided. The support mechanism or table 74 is briefly shown in FIG. 3 and detailedly shown in FIGS. 25 and 26.

Figure 25:
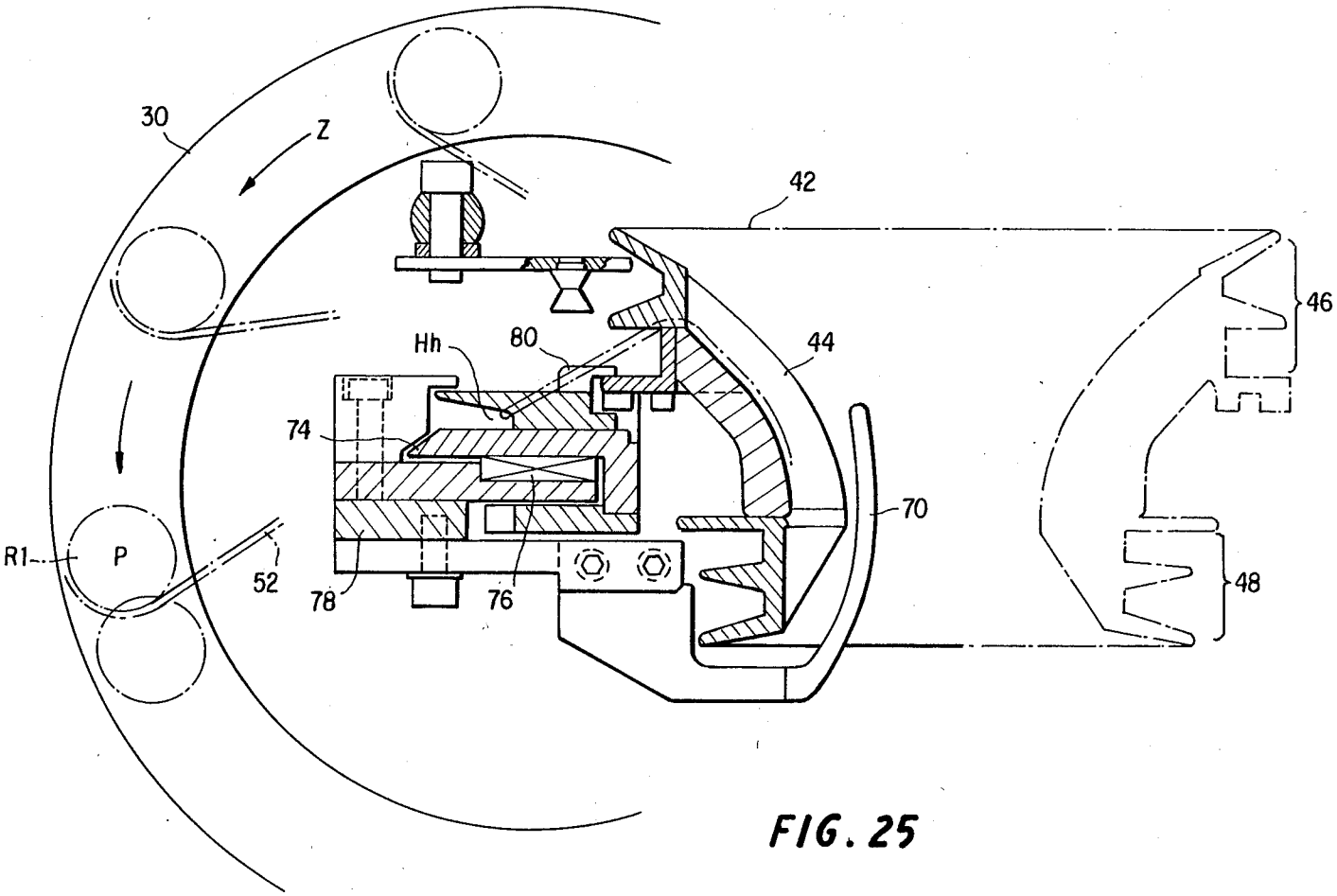
Figure 26:
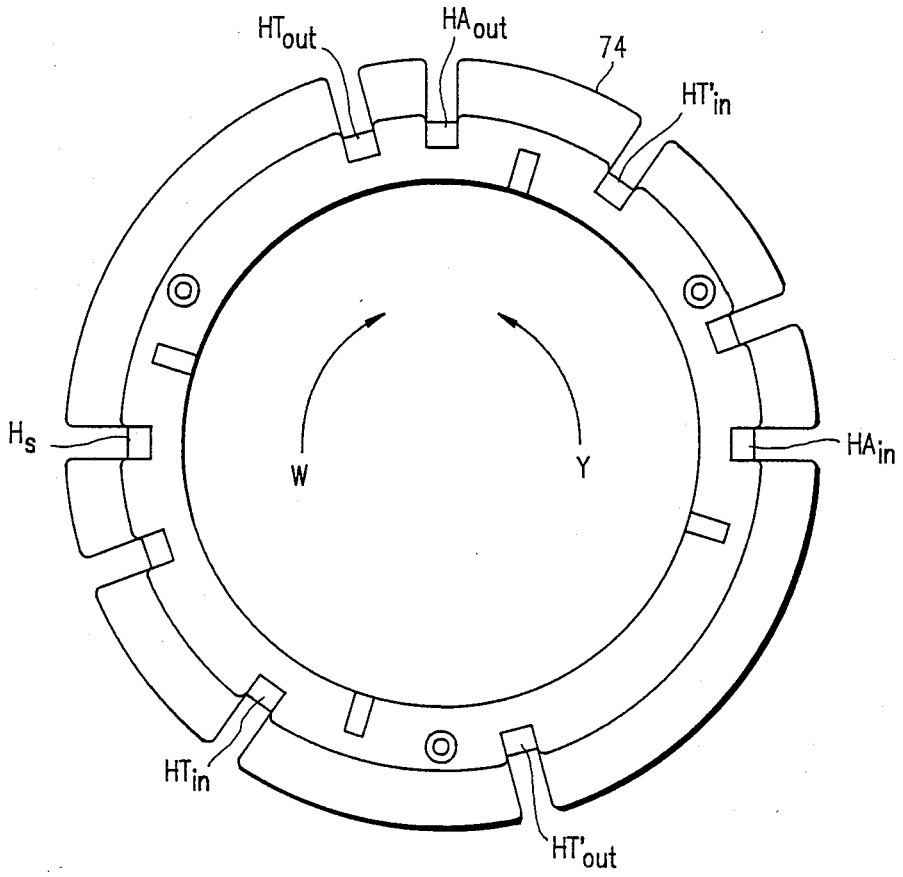
FIG. 26 is a plan view showing a support table.

More particularly, the spool 42, as shown in FIG. 26, is rotatably supported by the support table 74 formed into an annular shape as shown in FIG. 26 so that it may be intermittently rotated at an angle of $\alpha$ which is the angle of arrangement of the longitudinal slots 44. The support table 74, as shown in FIG. 25, is rotatably supported through a thrust needle bearing 76 on a fixed base 78 so that it may be rotated in a horizontal plane. Also, the support table 74 is provided with a holder 80 for securely positioning the spool 42 on the support table 74.

As shown in FIG. 26, the annular support table 74 is formed on an outer periphery thereof with a start groove Hs for holding the wire 52 therein when the winding is started, a first intermediate tap introducing groove HTin, a first intermediate tap drawing-out groove HTout, a second intermediate tap introducing groove HT'in, a second intermediate tap drawing-out groove HT'out, a waste winding introducing and ending groove HAin for forming waste winding required to join left and right coils to be wound on the spool 42, and a waste winding drawing-out groove HAout. The waste winding introducing and ending groove HAin serves to carry out introduction of waste winding, drawing-out of the wire 52 of which winding terminates, and cutting the drawn-out wire. The grooves are arranged in such a manner as shown in FIG. 26. Also, the support table 74, as shown in FIG. 25, is also formed with an outer peripheral groove Hh.

The manner of the winding apparatus equipped with the support mechanism or table constructed as described above will be described hereinafter with reference to FIGS. 1, 3, 6 to 20, and 25 to 27.

Figure 1:
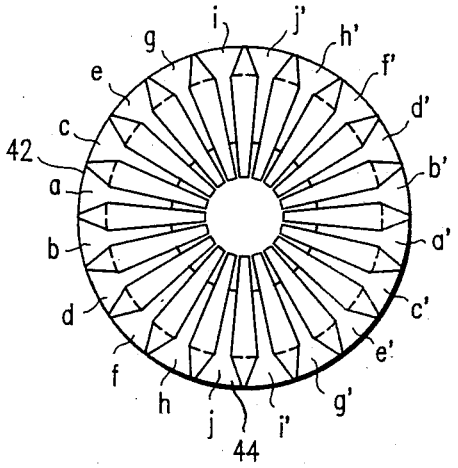
FIG. 1 PRIOR ART
FIG. 1 is a plan view generally showing a frame or spool of a deflection yoke.
Figure 2:
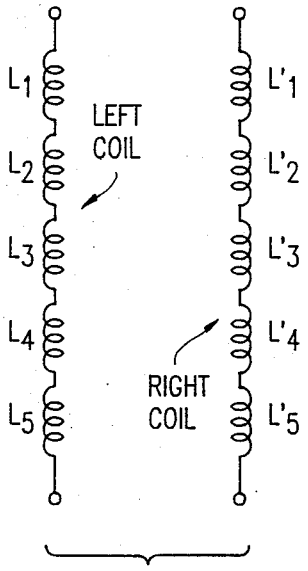
FIG. 2 PRIOR ART
FIG. 2 is a schematic view showing a procedure of winding by a conventional winding apparatus.

First, formation of a coil section L1 of a left coil in FIG. 27 by winding the wire between adjacent slots a and b of the longitudinal slots 44 of the cylindrical spool 42 shown in FIG. 1 will be described.

As shown in FIG. 6, the spool 42 is arranged in a manner to be fitted at a part thereof in the cylindrical spool 42 of the deflection yoke. Then, the wire 52 is held at any desired portion thereof on the upper end of any desired one of the longitudinal slots 44 through the start groove Hs of the support table 74 and then stretchedly wound on the rollers R1, R5, and R6 in turn, as shown in FIG. 6. The wire 52 is then guided to a tension device (not shown) to apply predetermined tension thereto.

Then, the rotor 30 is rotated in a clockwise direction from the original position of FIG. 6 through positions shown in FIGS. 7 to 11 to a position shown in FIG. 12, as indicated at an arrow X in each of FIGS. 6 to 11. Thus, operation shown in FIGS. 6 to 12 causes the wire 52 to be introduced in the specified one of the longitudinal slots 44 and guided therein from its upper end to its lower end.

Subsequently, as shown in FIG. 13, the frame or spool 42 of the deflection yoke which is adapted to be moved with the support table 74 is rotated in a counterclockwise direction Y in a horizontal plane by an angle equal to the angle $\alpha$ between the longitudinal slots 44 as the support table 74 is rotated in a horizontal plane. This results in the wire 52 being introduced into the lower lateral or circumferential annular channel 48 through which lower ends of the longitudinal slots 44 are communicated with one another.

Then, the rotor 30 is reversely rotated in a counterclockwise direction as indicated at an arrow Z in FIG. 14 and returned through positions shown in FIGS. 15 to 18 to the original position as shown in FIG. 19. This causes the wire 52 engaged with the lower channel 48 to be introduced in the next longitudinal slot 44 and guided from its lower end to its upper end.

Thereafter, the spool 42 is rotated in a clockwise direction as indicated at an arrow W in FIG. 20 in a horizontal plane by an angle of $\alpha$ as the support table 74 is rotated, so that the wire 52 may be introduced in the upper sideways or circumferential channel 46.

Again, the above-described procedures shown in FIGS. 6 to 20 are repeated plural times to carry out winding operation, resulting in the wire 52 being wound between the adjacent longitudinal slots 44 plural times.

Figure 27:
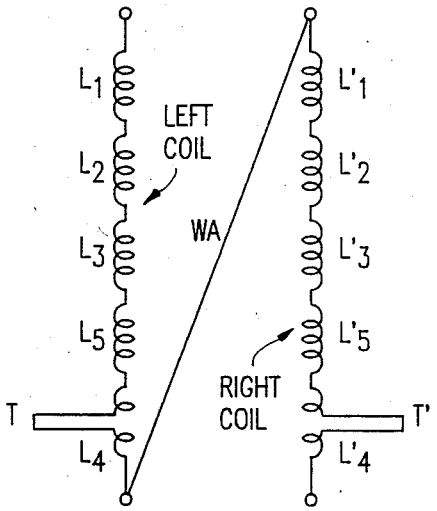
FIG. 27 is a schematic view showing procedures of winding of a wire on a deflection yoke in the present invention.

Similarly, the winding operation is successively carried out with respect to each pair of the longitudinal slots 44 (slots a-b, c-d, e-f, --- in FIGS. 20) positioned on both sides of the adjacent longitudinal slots 44 on which the winding operation has been carried out as described above, resulting in coil sections L2, L3, and L5 of a left coil shown in FIG. 27 being formed.

Formation of an intermediate tap T of the left coil shown in FIG. 27 is carried out in the course of formation of a coil section L4 of the left coil which is practiced by winding the wire 52 between the slots g-h of the longitudinal slots 44. More particularly, after the winding operation shown in FIGS. 6 to 20 is repeated several times, operation shown in FIGS. 6 to 19 takes place and then the roller R1 is lowered to a position indicated in dashed lines P in FIG. 25. At this time, the wire 52 just enters the first intermediate tap drawing-out groove HTout of the support table 74 and then is guided into the outer peripheral groove Hh of the support table 74 with rotation of the support table 74 and spool 42 in the W or clockwise direction. Then, the wire 52 is introduced through the first intermediate tap introducing groove HTin into the longitudinal slot 11 of the spool 42. Thereafter, operation shown in FIGS. 6 to 20 is repeated predetermined times to form the coil section L4.

Subsequent to formation of the left coil (coil sections L1 to L5), a right coil (coil sections L1' to L5') is formed. More particularly, procedures shown in FIGS. 6 to 19 are practiced for the final winding operation of the left coil, and then the roller R1 is lowered to the position P in FIG. 25. At this time, the wire 52 just enters the waste winding drawing-out groove HAout and is then guided into the outer peripheral groove Hh of the support table 74 with rotation of the support table 74 and the spool 42 in the Y direction. This results in the wire 52 being introduced from the waste winding introducing and ending groove HAin into the longitudinal slot 44 again, so that winding is carried out between slots a' and b' of the longitudinal slots 44. Subsequently, coil sections L'1 to L'3, L'5, and L'4 and an intermediate tap T' are formed in turn. Thereafter, the wire 52 enters the waste winding introducing and ending groove HAin and held therein.

Thus, arrangement of the support table 74 permits a pair of left and right coils to be successively wound on the spool 42. The so-formed coils are separated from each other when a waste winding portion WA (FIG. 27) is cut. Also, the intermediate taps T and T' of the left and right coils can be separated from the coils. An experiment by the inventors revealed that arrangement of the support table 74 permits eight terminals of 200 mm or more to be taken out when the spool 42 is detached from the winding apparatus.

It will thus be seen that the objects set forth above, among those made apparent from the preceding description, are efficiently attained. Moreover, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all the generic and specific features of the invention herein described and all statements of the scope of the invention which, as a matter of language, might be said to fall therebetween.

What is claimed is:

1. A winding apparatus for a deflection yoke having a cylindrical spool, said winding apparatus comprising:
   (a) a rotor arranged in a manner to surround a portion of the cylindrical spool of said deflection yoke, said cylindrical spool having an inner surface formed with longitudinal slots; and
   (b) means for rotating said rotor so as to cause a wire to be introduced into said longitudinal slots of said cylindrical spool,
   wherein:
   (c) said rotor is formed into an annular shape;
   (d) said rotor is provided with a plurality of rollers for guiding the wire to said longitudinal slots of said cylindrical spool.

2. A winding apparatus as defined in claim 1 and further comprising a winding alignment guide arranged closely opposite to ends of said longitudinal slots.

3. A winding apparatus as defined in claim 1 wherein:
   (a) said longitudinal slots are defined by projections on the inner surface of said rotor and
   (b) said winding apparatus further comprises a stationary winding guide arranged closely opposite to said projections.

4. A winding apparatus for a deflection yoke having cylindrical spool, said winding apparatus comprising:

(a) a rotor arranged in a manner to surround a portion of the cylindrical spool of said deflection yoke, said cylindrical spool having an inner surface formed with longitudinal slots; and (b) means for rotating said rotor so as to cause a wire to be introduced into said longitudinal slots of said cylindrical spool, wherein:

(c) said rotor is formed into an annular shape; and (d) said rotor is pivotally openable so as to be detachable with respect to said cylindrical spool.

5. A winding apparatus as defined in claim 4 and further comprising a winding alignment guide arranged closely opposite to ends of said longitudinal slots.

6. A winding apparatus as defined in claim 4 wherein:

(a) said longitudinal slots are defined by projections on the inner surface of said rotor and (b) said winding apparatus further comprises a stationary winding guide arranged closely opposite to said projections.

7. A winding apparatus for a deflection yoke having a cylindrical spool, said winding apparatus comprising:

(a) a rotor arranged in a manner to surround a portion of the cylindrical spool of said deflection yoke, said cylindrical spool having an inner surface formed with longitudinal slots;

(b) means for rotating said rotor so as to cause a wire to be introduced into said longitudinal slots of said cylindrical spool; and (c) a support mechanism rotated with said cylindrical spool, said support mechanism being formed with a waste winding groove for forming laterally adjacent coils in said cylindrical spool.

8. A winding apparatus as defined in claim 7, wherein said support mechanism is also formed with an intermediate tap drawing-out groove.

9. A winding apparatus as defined in claim 8 wherein said support mechanism is formed into an annular shape, said waste winding groove and said intermediate tap drawing-out groove being formed on an outer peripheral portion of said support mechanism.

10. A winding apparatus as defined in claim 7, wherein said support mechanism is formed into an annular shape.

11. A winding apparatus as defined in claim 7 wherein said support mechanism is formed into an annular shape, said waste winding groove being formed on an outer peripheral portion of said support mechanism.

12. A winding apparatus as defined in claim 7 and further comprising a winding alignment guide arranged closely opposite to ends of said longitudinal slots.

13. A winding apparatus as defined in claim 7 wherein:

(a) said longitudinal slots are defined by projections on the inner surface of said rotor and (b) said winding apparatus further comprises a stationary winding guide arranged closely opposite to said projections.

14. A winding apparatus as defined in claim 7 wherein said rotor is formed into an annular shape.

* * * * *